US009903575B2

(12) United States Patent
Ilenbiluan et al.

(10) Patent No.: US 9,903,575 B2
(45) Date of Patent: Feb. 27, 2018

(54) HIGH AND LOW VOLTAGE SEPARATING DRIVER BRACKETS FOR LIGHTING SYSTEMS AND METHODS FOR INSTALLATION

(71) Applicant: ABL IP Holding LLC, Conyers, GA (US)

(72) Inventors: Seun Ilenbiluan, Conyers, GA (US); Aaron Feldman, Atlanta, GA (US); Mike Ken Juda, Milipitas, CA (US); Jeff Shaner, Covington, GA (US)

(73) Assignee: ABL IP Holding LLC, Atlanta, GA (US)

( * ) Notice: Subject to any disclaimer, the term of this patent is extended or adjusted under 35 U.S.C. 154(b) by 56 days.

(21) Appl. No.: 14/992,380

(22) Filed: Jan. 11, 2016

(65) Prior Publication Data

US 2016/0201887 A1 Jul. 14, 2016

Related U.S. Application Data

(60) Provisional application No. 62/101,626, filed on Jan. 9, 2015.

(51) Int. Cl.

| | |
|---|---|
| ***F21V 19/00*** | (2006.01) |
| ***F21V 21/00*** | (2006.01) |
| ***F21V 23/00*** | (2015.01) |
| ***F21S 8/02*** | (2006.01) |
| ***F21V 17/00*** | (2006.01) |
| *F21Y 115/10* | (2016.01) |

(52) U.S. Cl.

CPC ..... *F21V 23/008* (2013.01); *F21S 8/026* (2013.01); *F21V 17/002* (2013.01); *F21Y 2115/10* (2016.08)

(58) Field of Classification Search

CPC ..... F21S 8/026
USPC ..... 362/382
See application file for complete search history.

(56) References Cited

U.S. PATENT DOCUMENTS

| | | | | |
|---|---|---|---|---|
| 3,363,094 | A * | 1/1968 | McLaughlin | H01R 33/0881 439/241 |
| 6,664,467 | B1 * | 12/2003 | de la Borbolla | H02G 3/14 174/503 |
| 7,234,670 | B1 * | 6/2007 | Gretz | F21V 11/02 174/37 |
| 8,854,796 | B2 | 10/2014 | Wilcox | |
| 8,995,114 | B2 | 3/2015 | Wilcox | |
| 2004/0252489 | A1 * | 12/2004 | Hagen | F21S 8/022 362/153.1 |
| 2007/0103330 | A1 * | 5/2007 | McGrath | G08B 17/10 340/693.1 |
| 2008/0266849 | A1 * | 10/2008 | Nielson | F21V 23/026 362/221 |
| 2010/0000756 | A1 * | 1/2010 | Peck | H01R 13/514 174/51 |

(Continued)

*Primary Examiner* — Tuyen K Vo
(74) *Attorney, Agent, or Firm* — Kilpatrick Townsend & Stockton, LLP

(57) ABSTRACT

Described are embodiments of driver brackets having dividers that separate low voltage wires from high voltage wires within a driver enclosure so as to reduce the risk of high and low voltage wires coming into contact within the driver enclosure. Also described are embodiments of driver brackets that support a driver entirely on one side of the driver bracket.

21 Claims, 8 Drawing Sheets

(56) References Cited

U.S. PATENT DOCUMENTS

| | | | | |
|---|---|---|---|---|
| 2012/0031640 | A1* | 2/2012 | Korcz | H02G 3/086<br>174/66 |
| 2012/0305307 | A1* | 12/2012 | Korcz | H02G 3/085<br>174/562 |
| 2014/0307445 | A1 | 10/2014 | Highbridge | |

* cited by examiner

HIGH AND LOW VOLTAGE SEPARATING DRIVER BRACKETS FOR LIGHTING SYSTEMS AND METHODS FOR INSTALLATION

CROSS REFERENCE TO RELATED APPLICATIONS

This application claims the benefit of U.S. Provisional Application Ser. No. 62/101,626 ("the '626 application"), filed on Jan. 9, 2015 and entitled "LED Driver Enclosure with High Voltage and Low Voltage Divider." The '626 application is hereby incorporated in its entirety by this reference.

FIELD OF THE INVENTION

Embodiments of the invention relate to enclosures for light engine drivers with dividers for high and low voltage wiring.

BACKGROUND

Luminaires, particularly those with light engines that require a driver or other electrical device, often consist of multiple components assembled into the luminaire or lighting system. Often times a driver or other necessary equipment will be located within an enclosure. The driver may be used to convert incoming electricity to a different voltage, amperage, or the like. The result is that the driver, which is contained in an enclosure, must receive wires that carry different voltages or currents. If wires with dissimilar electrical loads come into contact with one another within the enclosure, there may be a risk of fire, short circuit, or failure of the luminaire.

SUMMARY

Aspects of the present disclosure relate to light engine driver brackets that incorporate a divider that separates low voltage wires from high voltage wires within a driver enclosure. The driver bracket partitions the driver enclosure into regions where wires of different voltages are confined to prevent unwanted contact or interaction. These driver brackets allow an installer to quickly and easily install or replace a driver while reducing the possibility of installation errors or wire migration that may bring wires of dissimilar voltages into contact with one another.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The described embodiments of the invention provide a driver bracket for separating high and low voltage wires within a driver enclosure. While the driver brackets are discussed for use with light engines, they are by no means so limited. Rather, embodiments of the driver bracket may be used in any electrical device.

Embodiments of the invention relate to a driver enclosure for a light engine driver for powering a light engine assembly. The driver enclosure includes a divider for separating high voltage and relatively lower voltage wires in the enclosure. In one embodiment, the light engine assembly is a light-emitting diode (LED) assembly and the light engine driver is an LED driver.

Figure 1:
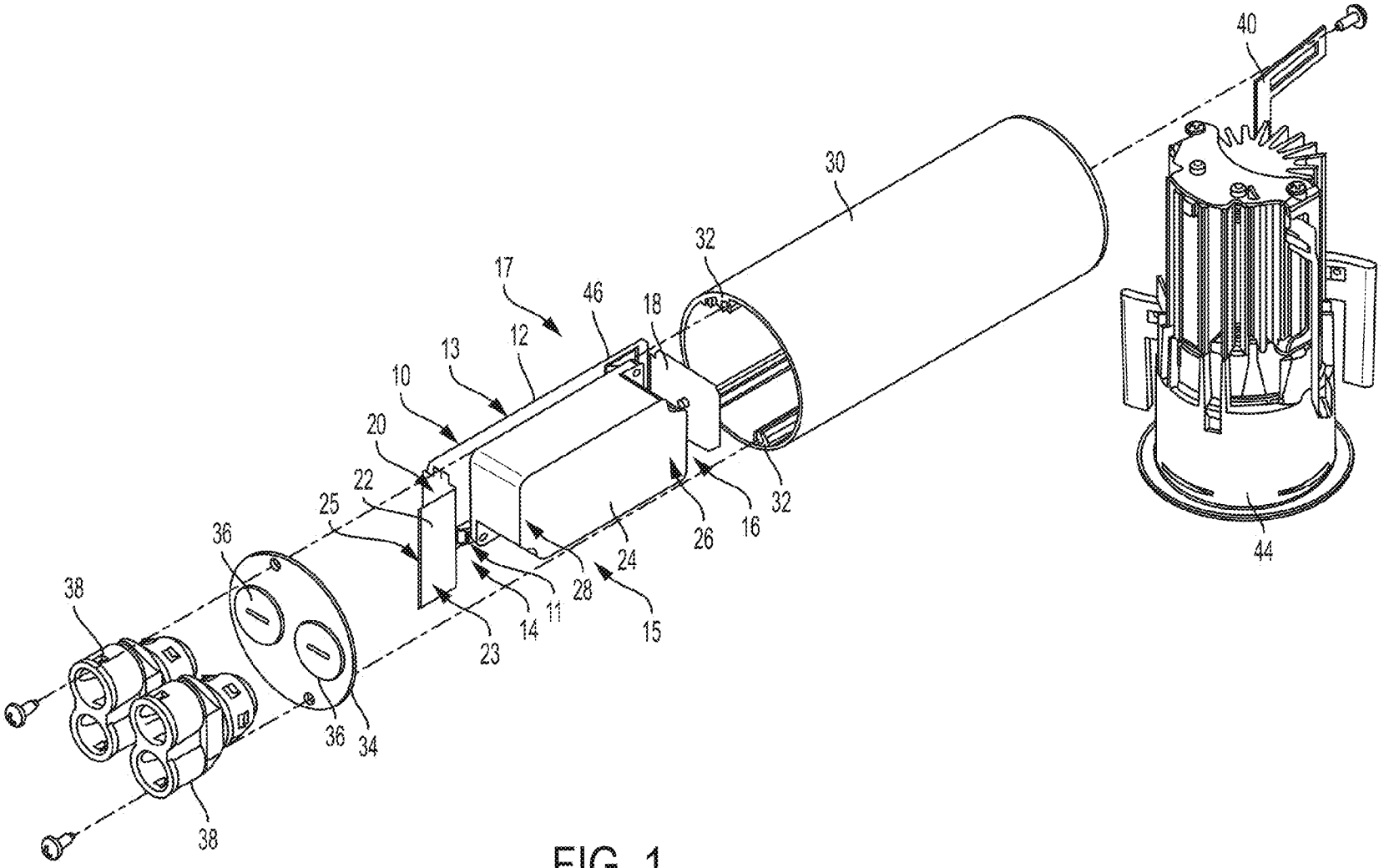
FIG. 1 is an exploded perspective view of a driver enclosure and light engine assembly according to certain embodiments of the present invention.
Figure 2:
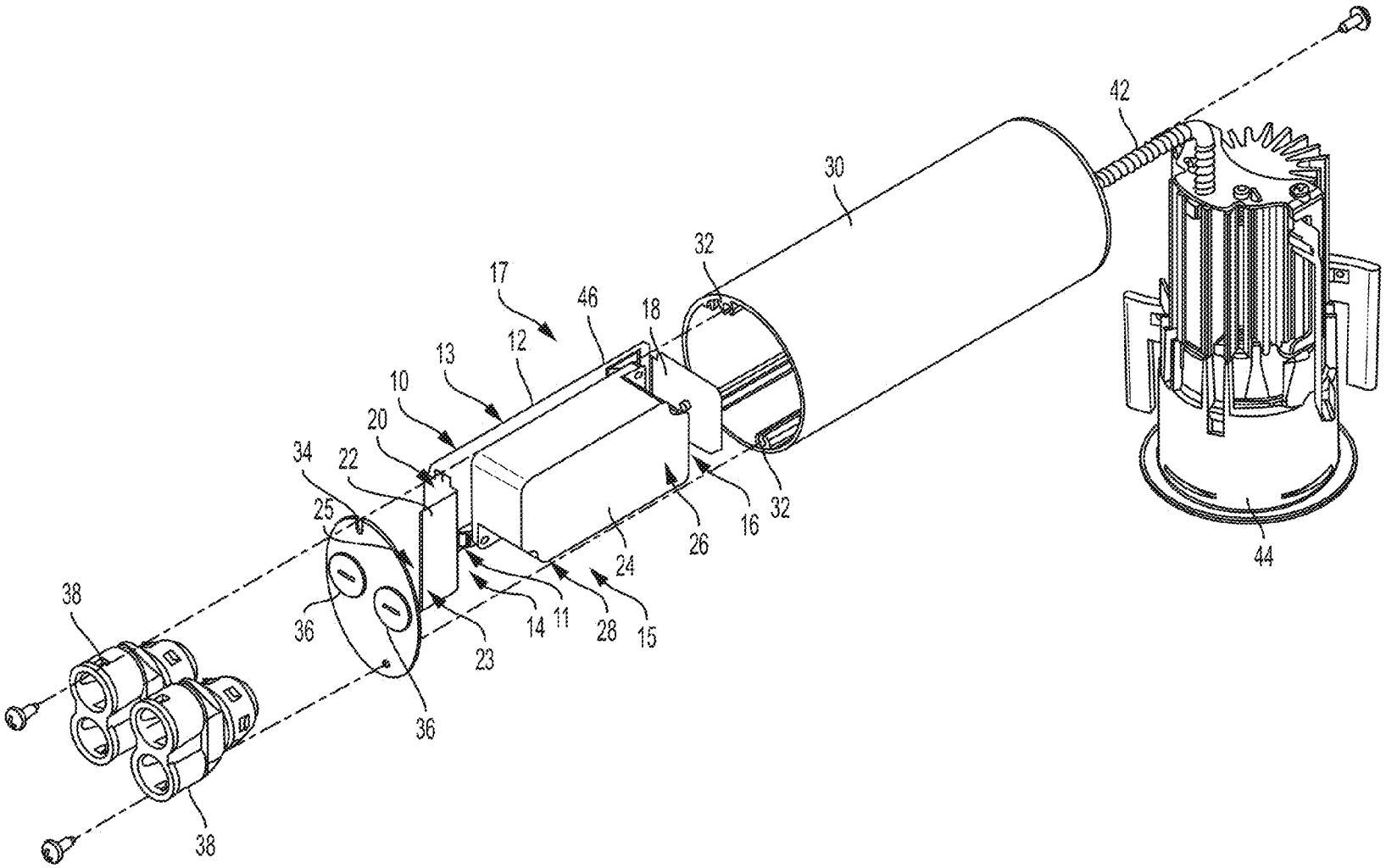
FIG. 2 is an exploded perspective view of a driver enclosure and light engine assembly according to certain embodiments of the present invention.
Figure 3:
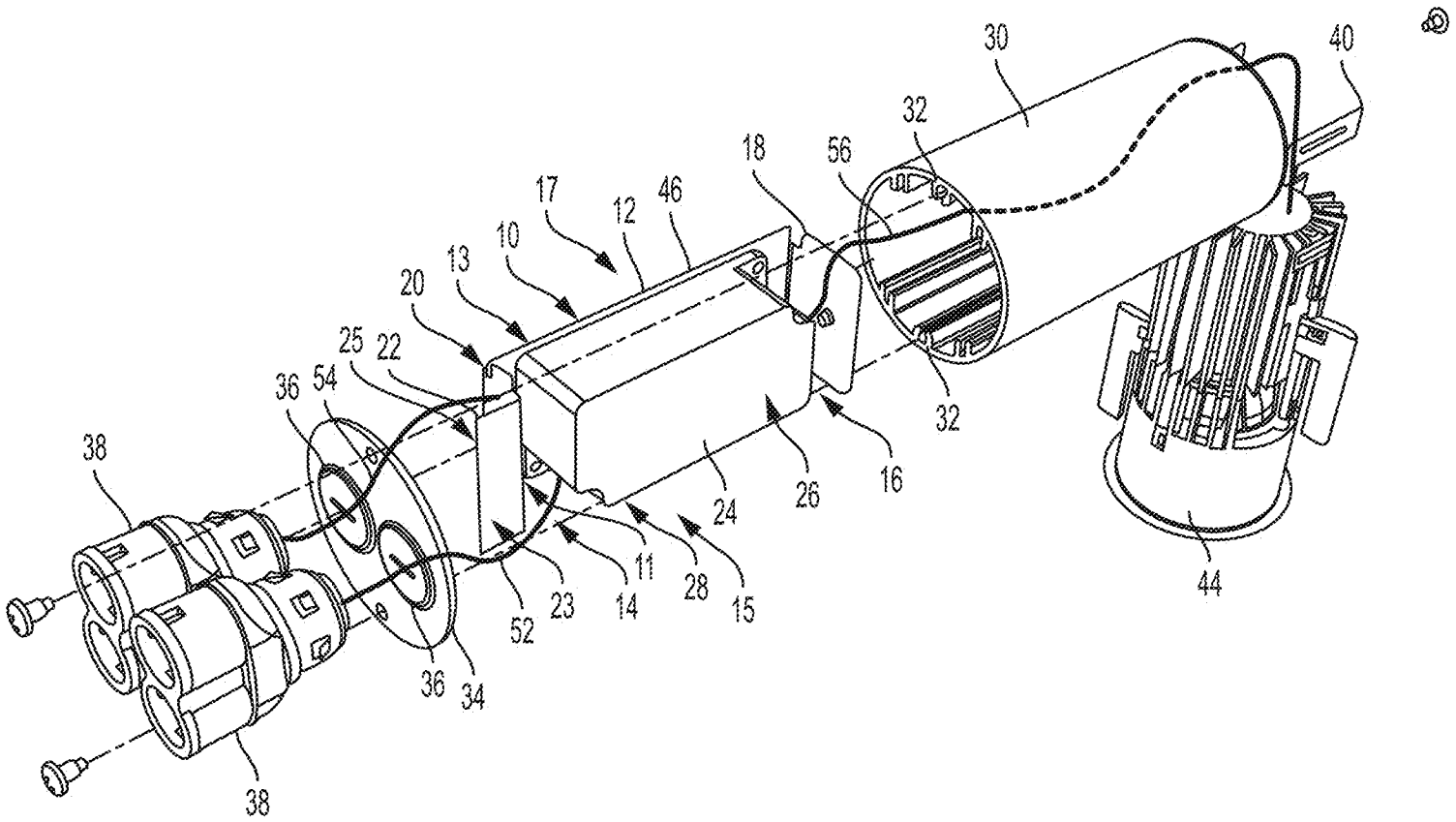
FIG. 3 is an exploded perspective view of the driver enclosure and light engine assembly of FIG. 1 with high and low voltage wiring.

FIGS. 1-4 are exploded perspective views of a driver enclosure 30 with a driver bracket 10 and light engine driver 24. As illustrated, the driver enclosure 30 is cylindrical, but other shapes and/or geometries are contemplated. The driver enclosure 30 is in communication with a light engine assembly 44. In FIGS. 1 and 3, the driver enclosure 30 is attached to the light engine assembly 44 with a light engine support bracket 40, while in FIGS. 2 and 4 the driver enclosure 30 is attached to the light engine assembly 44 with a flexible conduit 42. With reference to FIGS. 1-4, the divider 22 may be, but does not have to be, incorporated into a driver bracket 10 onto which the light engine driver 24 is attached. The driver bracket 10 is located within the driver enclosure 30 and securely retains the light engine driver 24. The light engine driver 24 includes a low voltage end 26 and a high voltage end 28. Similarly, the driver bracket 10 includes a high voltage end 14 and a low voltage end 16. One or more relatively high voltage input power wires 52 (e.g., 120-277 V) deliver power to the high voltage end 28 of the light engine driver 24, which transforms the power to a lower voltage (e.g., 60 V), and one or more low voltage output power wires 56 exit the low voltage end 26 of the light engine driver 24 and deliver power to at least one light engine assembly 44.

Figure 11:
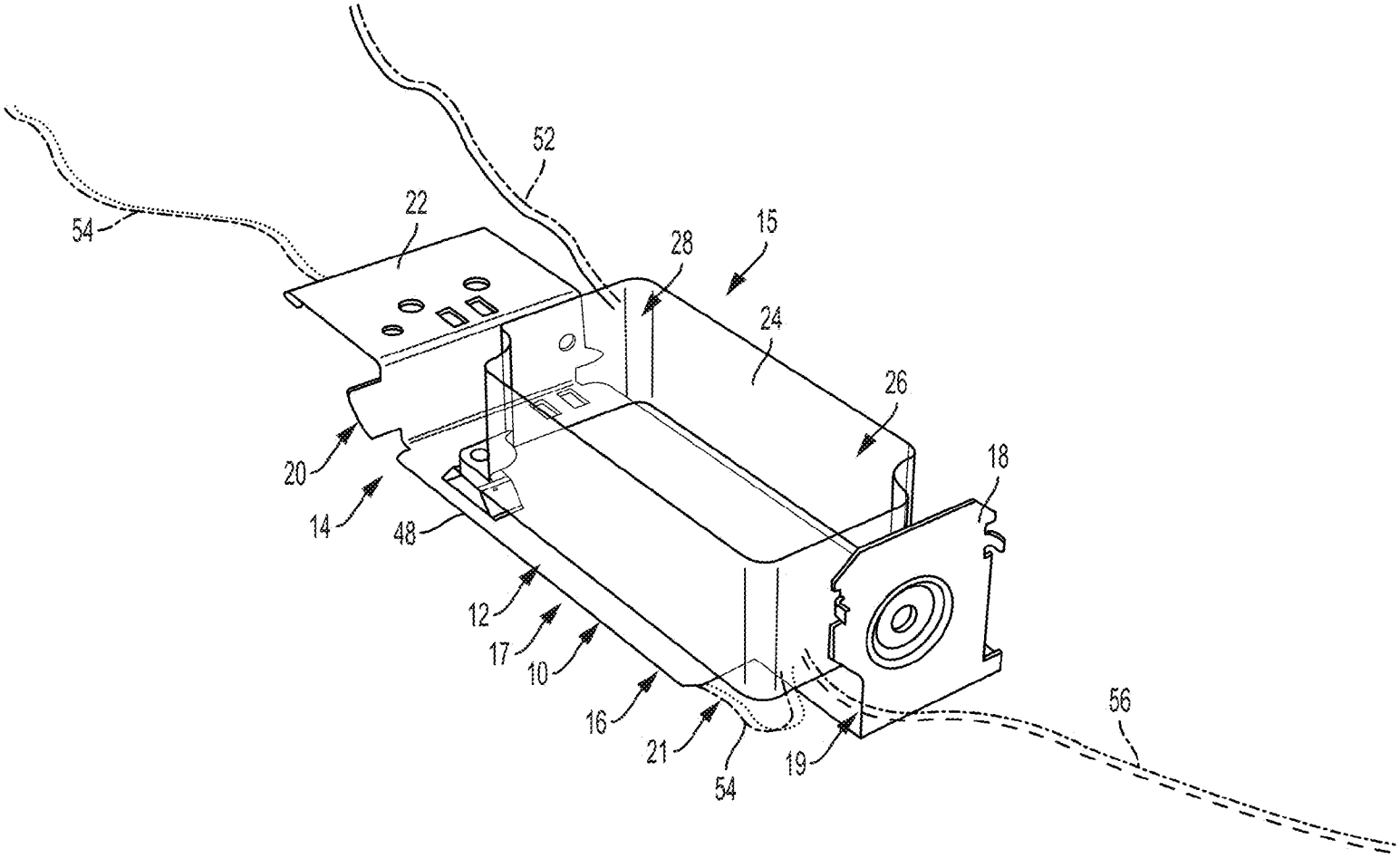
FIG. 11 is a perspective view of a driver bracket with a divider and high and low voltage wires.

The driver bracket 10 is formed of a substantially planar base 12 having a front surface 11, a back surface 13, a top edge 46, and a bottom edge 48 (visible in FIG. 11). A divider 22 is provided on the high voltage end 14 of the driver bracket 10. The divider 22 is supported by an upstanding arm 20 that extends upwardly from the base 12. The base 12, upstanding arm 20, and divider 22 collectively define a front portion 15 and a back portion 17 opposite the front portion 15 of the driver bracket 10. The divider 22 is shown extending substantially parallel to the base 12 but may extend at an angle relative to the base 12 so long as it permits wires to pass on each side (on the first side 23 and on the second side 25) of the divider 22 when the driver bracket 10 is positioned within the driver enclosure 30. Furthermore, in certain embodiments the divider 22 may extend directly from the base 12 of the driver bracket 10 as a straight or angled structure without the upstanding arm 20. The upstanding arm 20 may be of any length, but most often will be of a length such that the divider 22 extends relatively centrally within the driver enclosure 30. An optional back plate 18 may extend upwardly from the low voltage end 16 of the driver bracket 10. The optional back plate 18 may serve as a mounting point between the driver bracket 10 and the driver enclosure 30, and may serve as an anchor point or attachment points for one or more wires 52, 54, 56. The driver bracket 10 may be formed integrally or, alternatively, the various components may be formed separately and subsequently assembled together to form the driver bracket 10. The driver bracket 10 may be formed of any suitable material, such as aluminum, steel or a polymeric material.

Previous bracket configurations have included an aperture in the bracket in which the driver is positioned, splitting the driver into a high voltage side on one side of the bracket and a low voltage side on the other side of the bracket. Unlike these prior constructions, the driver bracket 10 of the present invention does not include an aperture to receive the driver. Rather, the light engine driver 24 is located entirely on one side (such as front surface 11) of the base 12 of the driver bracket 10, with physical separation of high voltage and low voltage wires provided by the divider 22, as discussed below. One benefit of this configuration is that the entire light engine driver 24 is accessible to the electrician from a single side of the driver bracket 10, simplifying the electrician's access and attachment of the various wires to the light engine driver 24.

Figure 4:
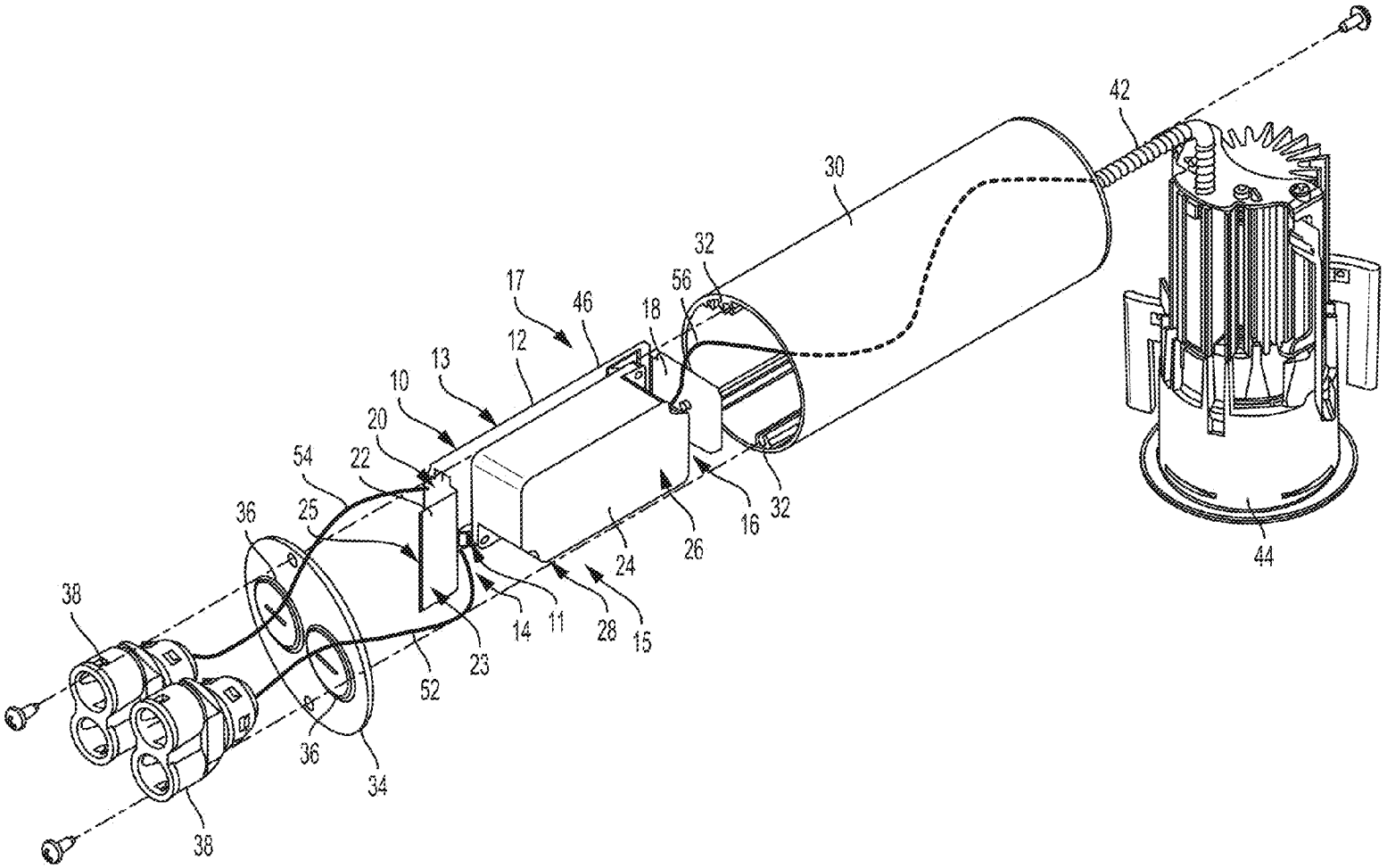
FIG. 4 is an exploded perspective view of the driver enclosure and light engine assembly of FIG. 2 with high and low voltage wiring.
Figure 6:
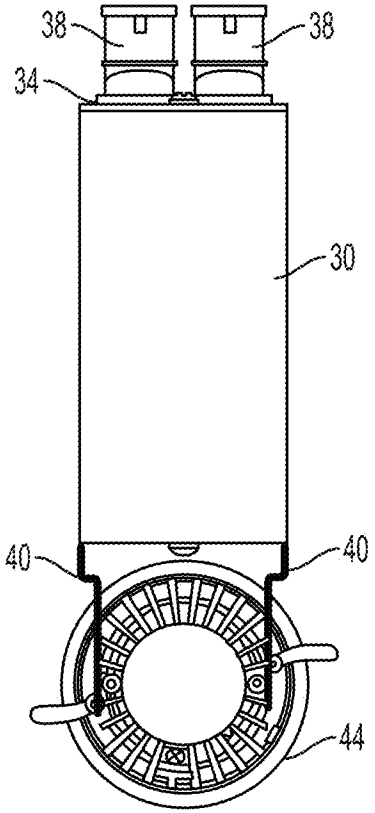
FIG. 6 is a plan view of the driver enclosure and light engine assembly of FIG. 1.
Figure 5:
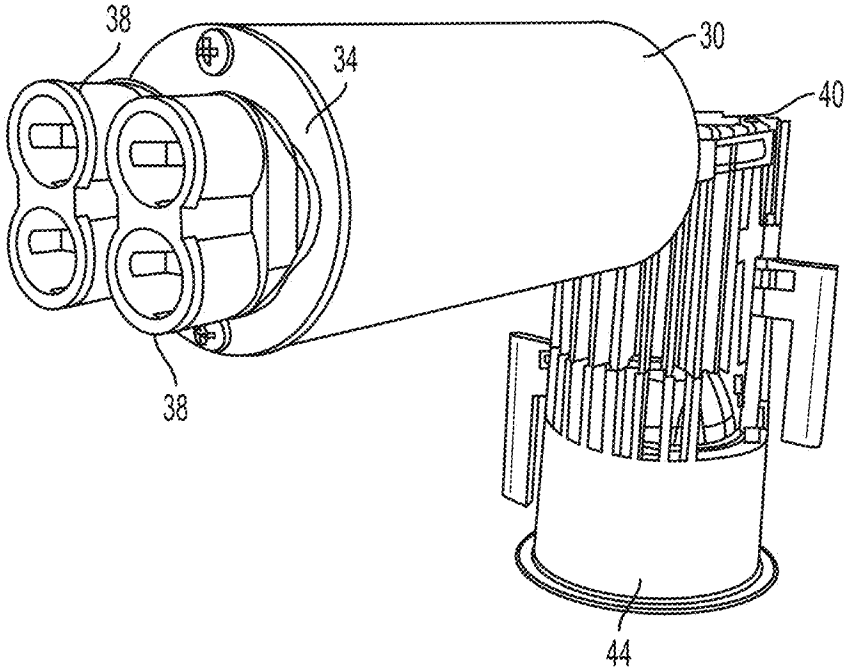
FIG. 5 is a perspective view of the driver enclosure and light engine assembly of FIG. 1.
Figure 8:
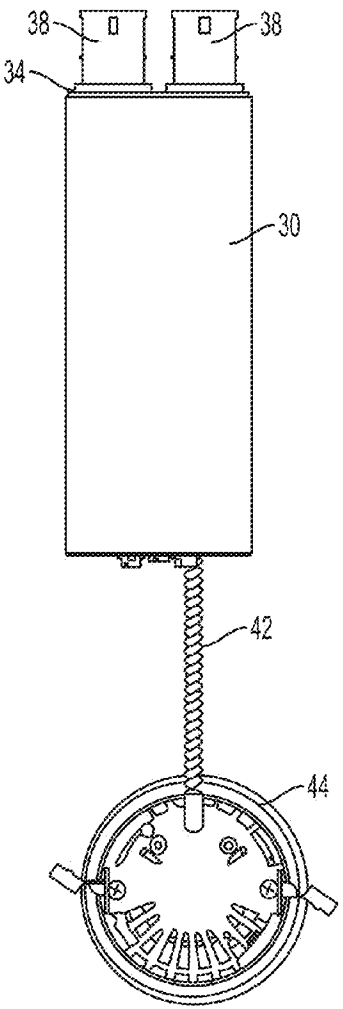
FIG. 8 is a plan view of the driver enclosure and light engine assembly of FIG. 2.
Figure 7:
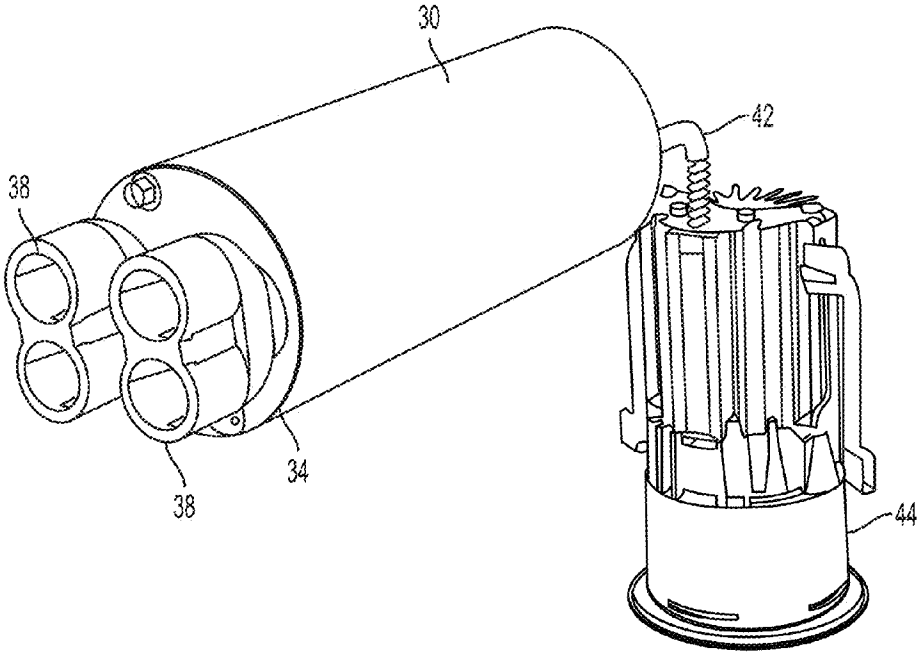
FIG. 7 is a perspective view of the driver enclosure and light engine assembly of FIG. 2.
Figure 10:
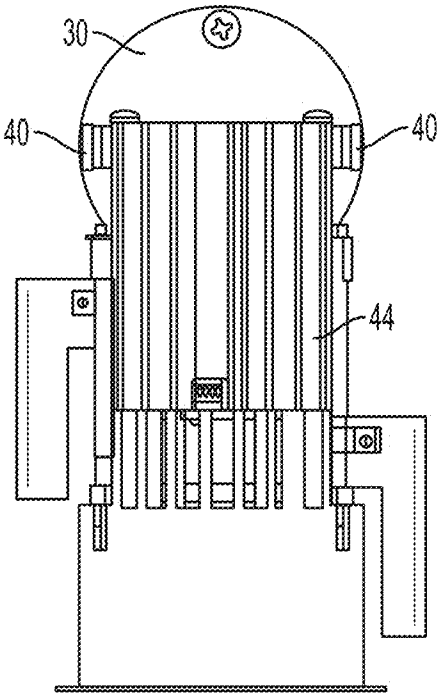
FIG. 10 is a rear view of the driver enclosure and light engine assembly of FIG. 1.
Figure 9:
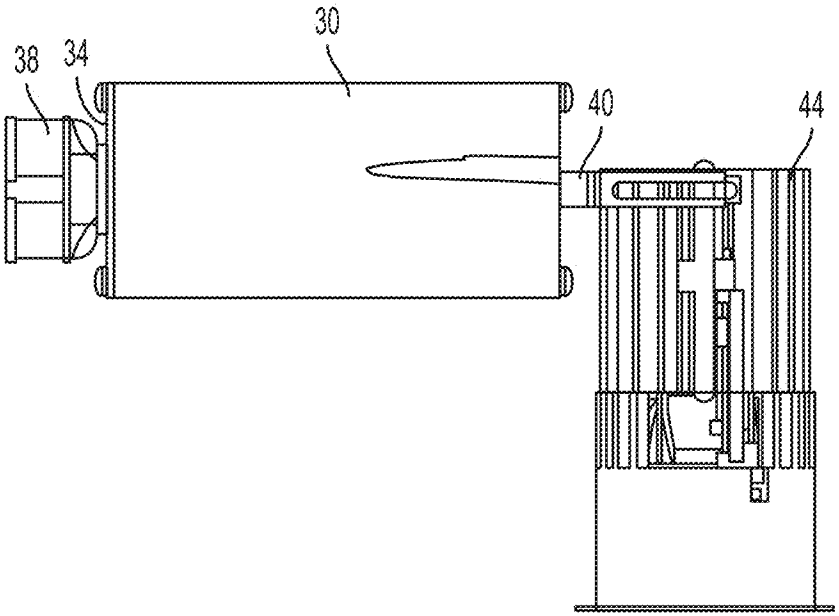
FIG. 9 is a side view of the driver enclosure and light engine assembly of FIG. 1.

In use, the driver bracket 10 serves to physically separate high voltage input power wires 52 and low voltage wires 54, 56 in the driver enclosure 30. The driver bracket 10, including the divider 22, may partition the driver enclosure 30 into high and low voltage regions where wires carrying different potentials may be housed. Physical separation of the wires is desirable for safety purposes and to meet various electrical code requirements. Exemplary wire routing diagrams are shown in FIGS. 3, 4, and 11, in which one or more high voltage input power wire(s) 52 are routed along the front portion 15 of the driver bracket 10 and into the light engine driver 24, and a low voltage control wire 54, such as an optional dimming wire (which may, but does not have to, operate at around 10 V and which could be provided to allow the light engine assembly 44 to be dimmable), is routed along the back portion 17 of the driver bracket 10 to the light engine driver 24 and into the low voltage end 26 of the light engine driver 24 (best seen in FIG. 11). The divider 22 serves to physically separate and maintain such separation between the high voltage input power wire(s) 52 and the low voltage control wire(s) 54 at the high voltage end 28 of the light engine driver 24.

In certain embodiments, as shown in FIG. 11, the driver bracket 10 may include a wire clearance 21 in the base 12 and/or optional back plate 18 near the low voltage end 16 of the driver bracket 10. The wire clearance 21 provides a space for the low voltage control wire 54, which would otherwise be confined to the back portion 17 of the driver bracket 10, to wrap around and connect to the low voltage end 26 of the light engine driver 24 in the front portion 15 of the driver bracket 10, and provide control, such as for a dimmer switch. The wire clearance 21 should be sized and located appropriately to minimize the risk of interaction between the low voltage control wire 54 and the high voltage input power wire 52 and/or the low voltage output power wire 56.

Physical separation of the high voltage input power wire(s) 52 from the low voltage output wire(s) 56 (which power the at least one light engine assembly 44) is achieved by locating the low voltage output power wires 56 on the low voltage end 26 of the light engine driver 24, as shown in FIGS. 2, 4, and 11. The low voltage output wire(s) 56 exit the driver enclosure 30 and are connected to at least one light engine assembly 44. The driver bracket 10 may include an exit clearance 19 in the optional back plate 18 and/or base 12 at the low voltage end 16 of the driver bracket 10 to allow the low voltage output power wire 56 to connect to the low voltage end 26 of the light engine driver 24 and then pass through the driver enclosure 30 and on to a light engine assembly (not shown).

Clearances 19, 21 may take on any number of configurations or arrangements, including notches, apertures, or other passages that may confine or otherwise restrict the wires to prevent unwanted intermingling of wires with different potentials, while still allowing for the routing of wires as necessary for the application.

While one particular wire routing configuration is illustrated in FIGS. 2, 4, and 11, it will be recognized that other wire routing possibilities may be utilized. For example the high voltage input power wire 52 may be routed by the divider 22 into the back portion 17 of the driver bracket 10 and the low voltage control wire 54 (if used) could be routed by the divider 22 into the front portion 15 of the driver bracket 10. Further, as noted above, the low voltage control wire 54 is optional; if the light engine assembly 44 need not be dimmable the low voltage control wire 54 could be omitted, and another high voltage input power wire 52 could be provided and routed along the same path as the high voltage input power wire 52 or alternatively routed as low voltage control wire 54 shown in FIGS. 2 and 4 to provide an alternate high voltage pathway.

Still referring to FIGS. 1-4, installation of the driver bracket 10 with its associated light engine driver 24 into the driver enclosure 30 may first require mounting or otherwise affixing the light engine driver 24 to the driver bracket 10 (e.g., to the front surface 11 or back surface 13 of the base 12). First, the light engine driver 24 should be aligned with the driver bracket 10 so that the low voltage end 26 of the light engine driver 24 is in proximity to the low voltage end 16 of the driver bracket 10. Once the driver bracket 10 and light engine driver 24 are properly aligned, the light engine driver 24 may be fastened, snapped, or otherwise affixed to the base 12 of the driver bracket 10. As shown, the base 12 of the driver bracket 10 may be substantially planar without any holes or apertures that are large enough for the light engine driver 24 to pass through. That is, the light engine driver 24 will be confined to one side (either the front surface 11 or the back surface 13) of the base 12 of the driver bracket 10 and will not fully or partially penetrate the base 12 of the driver bracket 10.

The light engine driver 24 may then be wired by connecting a high voltage input power wire 52 to the high voltage end 28 of the light engine driver 24. Similarly, the low voltage output power wire 56 may be connected to the low voltage end 26 of the light engine driver 24. In certain cases, the light engine driver 24 may also be connected to a low voltage control wire 54, such as for a dimmer switch. After all the desired wire connections to the light engine driver 24, the wires 52, 54, 56 may be routed appropriately to prevent mixing or interference between the high voltage input power wire 52 and the low voltage control wire 54 and/or low voltage output power wire 56. For example, in certain cases, the high voltage input power wire 52 may be routed by the divider 22 into the front portion 15 of the of the driver bracket 10, while the low voltage control wire 54 may be routed by the divider 22 into the back portion 17 of the driver bracket 10. The divider 22 serves to separate the high voltage input power wire 52 from the low voltage control wire 54 to prevent interference or interaction between the wires 52, 54, which may lead to short circuits, fire hazard, or failure of the light engine driver 24 and/or light engine assembly 44. The low voltage output power wire 56 may similarly be separated from the high voltage input power wire 52 by the separation due to the length of the light engine driver 24 and driver bracket 10.

After the wires 52, 54, 56 are properly routed, the driver bracket 10 with mounted light engine driver 24 may be inserted or otherwise installed into the driver enclosure 30. During insertion, any excess wire 52, 54, 56 may be coiled or otherwise wrapped up to fit within the driver enclosure 30. In certain cases, the driver bracket 10 may locate and stabilize the light engine driver 24 and wires 52, 54, 56 within the driver enclosure 30 by the interaction of the driver bracket 10 with the interior surface of the driver enclosure 30. In certain embodiments, the driver enclosure 30 may include one or more guide channels 32 or other features on its inner surface that may engage with the top edge 46 and/or bottom edge 48 of the base 12 to guide the insertion and maintain the location of the driver bracket 10 in the driver enclosure 30. As installed, the driver bracket 10 may partition the driver enclosure 30 into a low voltage region and a high voltage region. These regions provide the volume for wires of different potential within the driver enclosure 30 while reducing or eliminating the risk of wires of different potential interacting with one another.

An endplate 34 may attach (such as with fasteners, snaps, adhesives, or any other suitable attachment means) to one end of the driver enclosure 30 and enclose the driver bracket 10 and light engine driver 24 therein. The endplate 34 may have one or more knockouts 36, which, if needed, could be removed to provide an aperture (not shown) and allow power wires, such as the high voltage input power wire 52 and optional low voltage control wire 54, to be passed through the endplate 34. These knockouts 36 may be positioned on the endplate 34 such that a wire or other equipment passing through an aperture is easily directed by the divider 22 into one side (either the front portion 15 or back portion 17) of the driver bracket 10. This allows additional high or low voltage wires to be fed through the driver enclosure 30 and directed to the high or low voltage regions to prevent comingling or unwanted interaction between wires of differing potentials.

In some embodiments, the length of the driver bracket 10 and/or divider 22 is such that the divider 22 may contact the inner surface of the endplate 34 when the driver bracket 10 is positioned within the driver enclosure 30 so as to completely separate the low and high voltage regions within the driver enclosure 30. The divider 22 provides physical separation between the knockouts 36 so that high voltage input power wires 52 passing through one knockout 36 and into the front portion 15 of the driver bracket 10 are prevented from inadvertently contacting low voltage control wires 54 (e.g., a dimming wire) passing through another knockout 36 and into the back portion 17 of the driver bracket 10.

In other embodiments, there may be a small space or gap between the inner surface of the endplate 34 and the divider 22. This gap, the size of which may be chosen based upon the size of the driver enclosure 30, gauge or length of wires 52, 54, 56, and/or any other factors as necessary for a particular application, may provide clearance to prevent or reduce pinch or other impingement of wires 52, 54, 56 during the installation of the driver bracket 10 and/or endplate 34.

A conduit carrying the high voltage input power wire 52 and low voltage control wires 54 may attach directly to a knockout 36 on the endplate 34. Alternatively, as shown in the figures, multiple conduits carrying power wires may be directed into one or more 1-to-2 conduit converter 38, which would allow power wires from two (or more) conduits to be routed through a single knockout 36 on the endplate 34. In this manner, multiple light engine assemblies 44, each including its own driver enclosure 30 and/or light engine driver 24, could be connected in a series configuration, with a high voltage input power wire 52 coming from one conduit and being wired to a first light engine driver 24, and also being split so that another high voltage input power wire 52 can be passed through another conduit and to a second (or subsequent) downstream light engine assembly 44.

As shown in FIGS. 1, 3, 5, 6, 9, and 10, the driver enclosure 30 may be connected to at least one light engine assembly 44 with a light engine support bracket 40. As shown, the light engine support bracket 40 may allow the light engine assembly 44 to move horizontally relative to the driver enclosure 30 and to pivot at an angle relative to the driver enclosure 30 (as shown, the angle of the light engine assembly 44 relative to the driver enclosure 30 is approximately 90 degrees). The adjustability of the light engine assembly 44 relative to the driver enclosure 30 provides flexibility for placement of the light engine assembly 44 and the driver enclosure 30.

Similarly, as shown in FIGS. 2, 4, 7, and 8, the driver enclosure 30 may be connected to at least one light engine assembly 44 with a flexible conduit 42. The flexible conduit 42, which may be fastened to the inside of the driver enclosure 30 and/or the inside of the light engine assembly 44, provides a mechanical connection that allows the driver enclosure 30 and light engine assembly 44 to independently move relative to one another. This flexible connection facilitates installation of the light engine assembly 44 and/or driver enclosure 30 in a range of ceiling volumes or spaces. In certain embodiments, the conductors or wires between the driver enclosure 30 and light engine assembly 44 are contained within the flexible conduit 42.

Any of the above described components, parts, or embodiments may take on a range of shapes, sizes, or materials as necessary for a particular application of the described invention. The components, parts, or mechanisms of the described invention may be made of any materials selected for the suitability in use, cost, or ease of manufacturing. Materials including, but not limited to aluminum, stainless steel, fiber reinforced plastics, rubber, elastomers, carbon fiber, composites, polycarbonate, polypropylene, other metallic materials, or other polymers may be used to form any of the above described components.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A light fixture comprising:

a hollow driver enclosure having a first enclosure end, a second enclosure end, and an inner surface;

a driver bracket positioned within the driver enclosure and comprising:

a base extending in a plane and having a front surface, a back surface, a first bracket end, and a second bracket end opposite the first bracket end; and a divider associated with the base and extending in a plane that is non-perpendicular relative to the plane of the base; and a light engine driver mounted entirely on the front surface of the base and comprising a high voltage driver end proximate the first bracket end and a low voltage driver end proximate the second bracket end, wherein the driver bracket substantially divides the driver enclosure into a low voltage region and a high voltage region.

2. The light fixture of claim 1, wherein the driver bracket further comprises an arm extending upwardly from the base proximate the first bracket end and wherein the divider is connected to the base via the arm.

3. The light fixture of claim 1, further comprising:

a power input wire having a voltage, wherein the power input wire enters the first enclosure end, extends along a first side of the divider and within the high voltage region of the driver enclosure, and engages the light engine driver at the high voltage driver end; and a power output wire having a voltage lower than the voltage of the power input wire, wherein the power output wire extends from the light engine driver at the low voltage driver end and exits the second enclosure end.

4. The light fixture of claim 3, wherein the driver bracket further comprises a back plate extending upwardly from the base proximate the second bracket end.

5. The light fixture of claim 4, wherein an exit clearance is provided in the back plate to accommodate the power output wire extending from the light engine driver.

6. The light fixture of claim 3, further comprising an additional input wire having a voltage lower than the voltage of the power input wire, wherein the additional input wire enters the first enclosure end, extends along a second side of the divider and within the low voltage region of the driver enclosure, and engages the driver at the low voltage driver end.

7. The light fixture of claim 6, wherein a wire clearance is provided in the base of the driver bracket proximate the low voltage driver end and wherein the additional input wire crosses from the low voltage region of the driver enclosure into the high voltage region of the driver enclosure via the wire clearance before engaging the driver.

8. The light fixture of claim 6, further comprising an endplate mounted on the first enclosure end to enclose the driver enclosure at the first enclosure end, wherein the endplate comprises a plurality of apertures and wherein, when the endplate is mounted on the first enclosure end:

a first aperture of the plurality of apertures is disposed on a first side of the divider so as to be in communication with the high voltage region of the driver enclosure and receives the power input wire; and a second aperture of the plurality of apertures is disposed on a second side of the divider opposite the first side so as to be in communication with the low voltage region of the driver enclosure and receive the additional input wire.

9. The light fixture of claim 3, further comprising a light engine assembly powered at least partially by the power output wire.

10. The light fixture of claim 9, wherein the light engine assembly is movably connected to the driver enclosure.

11. The light fixture of claim 10, wherein the light engine assembly is movably connected to the driver enclosure with a bracket.

12. The light fixture of claim 10, wherein the light engine assembly is movably connected to the driver enclosure with a flexible conduit.

13. The light fixture of claim 12, wherein the power output wire extends between the driver enclosure and the light engine assembly within the flexible conduit.

14. The light fixture of claim 3, further comprising an endplate mounted on the first enclosure end to enclose the driver enclosure at the first enclosure end.

15. The light fixture of claim 14, wherein the divider contacts the endplate when the endplate is mounted on the first enclosure end so as to entirely separate the low voltage region and the high voltage region at the first enclosure end.

16. The light fixture of claim 1, further comprising at least one channel on the inner surface of the driver enclosure, wherein at least one of a top edge or a bottom edge of the driver bracket engages the at least one channel when positioned within the driver enclosure.

17. The light fixture of claim 1, wherein the divider is provided proximate the first bracket end.

18. A driver bracket comprising:

a base extending in a plane and having a front surface, a back surface, a first end, and a second end opposite the first end, wherein the base is adapted to support the entirety of a light engine driver on the front surface;

a back plate extending upwardly from the base proximate the second end of the base;

an arm extending upwardly from the base proximate the first end of the base; and a divider supported by the arm and extending in a plane that is non-perpendicular relative to the plane of the base; and the light engine driver positioned entirely on the front surface of the base.

19. A method for installing a light engine driver in a driver enclosure having a first enclosure end and a second enclosure end, the method comprising:

providing a driver bracket comprising a base extending in a plane and having a front surface, a back surface, a first bracket end, a second bracket end opposite the first bracket end and a divider associated with the base and extending in a plane that is non-perpendicular relative to the plane of the base;

aligning a low voltage driver end with the first bracket end;

aligning a high voltage driver end with the second bracket end;

mounting the light engine driver entirely on the front surface of the base;

connecting a power input wire having a voltage to the high voltage driver end;

connecting a power output wire having a voltage lower than the voltage of the power input wire to the low voltage driver end;

routing the power input wire along a first side of the divider; and inserting the driver bracket and the light engine driver into the first enclosure end;

wherein the driver bracket substantially divides the driver enclosure into a low voltage region and a high voltage region and wherein the power input wire is within the high voltage region.

20. The method of claim 19, further comprising connecting an additional input wire having a voltage lower than the voltage of the power input wire to the low voltage driver end and routing the additional input wire along a second side of the divider and within the low voltage region of the driver enclosure.

21. The method of claim 20, further comprising mounting an endplate with a plurality of apertures on the first enclosure end, wherein:

a first aperture of the plurality of apertures is disposed on the first side of the divider so as to be in communication with the high voltage region of the driver enclosure and receives the power input wire; and a second aperture of the plurality of apertures is disposed on the second side of the divider opposite the first side so as to be in communication with the low voltage region of the driver enclosure and receives the additional input wire.

* * * * *